US008024817B2

(12) United States Patent
So

(10) Patent No.: US 8,024,817 B2
(45) Date of Patent: Sep. 27, 2011

(54) WETSUIT, NECK OPENING FOR WETSUIT AND METHOD OF MAKING SAME

(75) Inventor: Simon So, Tuen Mun (HK)

(73) Assignee: Neil Pryde Limited, New Territories (HK)

( * ) Notice: Subject to any disclaimer, the term of this patent is extended or adjusted under 35 U.S.C. 154(b) by 56 days.

(21) Appl. No.: 12/422,324

(22) Filed: Apr. 13, 2009

(65) Prior Publication Data

US 2009/0255024 A1 Oct. 15, 2009

(30) Foreign Application Priority Data

Apr. 11, 2008 (HK) ..... 08104148.5

(51) Int. Cl.
*B63C 11/04* (2006.01)
*A41B 3/00* (2006.01)
*B63C 11/00* (2006.01)

(52) U.S. Cl. ..... 2/2.17; 2/2.15; 2/2.16; 2/131

(58) Field of Classification Search ..... 2/2.15, 2/2.16, 2.17, 131
See application file for complete search history.

(56) References Cited

U.S. PATENT DOCUMENTS 3,693,191 A * 9/1972 Dowsett ..... 2/131
3,744,054 A * 7/1973 Schultz ..... 2/2.15
4,341,331 A * 7/1982 McDougall ..... 224/219
4,375,107 A * 3/1983 Bachtiger ..... 2/131
4,710,978 A * 12/1987 Pankopf ..... 2/2.16
4,915,046 A * 4/1990 Meistrell ..... 112/419
4,953,232 A * 9/1990 Gaines et al. ..... 2/60
4,999,845 A * 3/1991 Jenks et al. ..... 2/2.16
5,046,193 A * 9/1991 Foresman et al. ..... 2/68
5,052,053 A * 10/1991 Peart et al. ..... 2/2.16
5,196,240 A 3/1993 Stockwell
5,359,735 A * 11/1994 Stockwell ..... 2/243.1
5,371,904 A * 12/1994 McEwen ..... 2/129
5,802,609 A * 9/1998 Garofalo ..... 2/2.17
6,124,010 A * 9/2000 Shih ..... 428/61
6,434,749 B1 * 8/2002 Grounds et al. ..... 2/2.15
6,473,904 B2 * 11/2002 Long ..... 2/2.15
6,514,590 B1 * 2/2003 Shih ..... 428/60
6,708,528 B2 * 3/2004 Chuang ..... 66/171
(Continued)

FOREIGN PATENT DOCUMENTS

EP 0 701 782 A1 3/1996
(Continued)

OTHER PUBLICATIONS

European Patent Office, Extended European Search Report in European Patent Application No. 09 25 1091 (Apr. 4, 2011).

*Primary Examiner* — Bobby Muromoto, Jr.
(74) *Attorney, Agent, or Firm* — Leydig, Voit & Mayer, Ltd.

(57) ABSTRACT

A wetsuit has a trunk portion having a pair of arm openings and a neck opening that fits about the torso of a wearer. The neck opening includes an area of reduced thickness that is folded to form a soft flexible edge. The neck opening is made by forming a channel of reduced thickness in a piece of material to surround the neck opening in the wetsuit, and folding the material along a centerline of the channel to form the soft flexible edge.

13 Claims, 5 Drawing Sheets

U.S. PATENT DOCUMENTS

| | | | | |
|---|---|---|---|---|
| 6,886,182 | B2 * | 5/2005 | Saillet et al. | 2/2.16 |
| D536,115 | S * | 1/2007 | Shiue | 2/2.15 |
| 2006/0073943 | A1 * | 4/2006 | Perka | 482/55 |
| 2006/0183850 | A1 * | 8/2006 | Liu et al. | 524/589 |
| 2007/0294797 | A1 * | 12/2007 | Furgerson et al. | 2/2.15 |
| 2008/0109926 | A1 * | 5/2008 | Lieberman | 2/2.16 |

FOREIGN PATENT DOCUMENTS

| | | | |
|---|---|---|---|
| FR | 1 599 770 | A | 8/1970 |
| GB | 2 277 433 | A | 11/1994 |

* cited by examiner

WETSUIT, NECK OPENING FOR WETSUIT AND METHOD OF MAKING SAME

BACKGROUND TO THE INVENTION

1. Field of the Invention

The invention relates to wetsuits and in particular to the neck opening of wetsuits and a method of making or forming the neck opening of a wetsuit.

2. Background Information

Wetsuits made from synthetic rubber, such as neoprene, of various thicknesses are well known. The top part of a wetsuit comprises a trunk portion that fits about the torso of a wearer. The trunk portion has a neck opening through which the head and neck of the wearer extend. The edge of the neck opening can be left as a plain or sealed neoprene edge, however this can be uncomfortable and produce skin chafing around the neck of a wearer. Alternatively, and as is common practice, the neck opening is folded over on itself and stitched or glued to provide a smooth rounded edge. However the double thickness of the edge is bulky and less flexible than the rest of the suit. Gluing and stitching the folded edge further reduces the flexibility and can add to the discomfort and chafing experienced by the wearer.

It is an object of the present invention to provide a wetsuit, wetsuit neck opening and a method of making same which overcomes or at least ameliorates problems with the neck opening of wetsuits known hitherto or, to at least provide the public with a useful alternative.

SUMMARY OF THE INVENTION

Accordingly there is disclosed herein a wetsuit having a truck portion to fit about the torso of a wearer, the trunk portion having a pair of arm openings and a neck opening, wherein the neck opening comprises an area of reduced thickness that is folded to form a soft flexible edge.

Preferably, the neck opening is formed by a collar panel made from a synthetic rubber having a first thickness that is affixed to the truck portion, the area of reduced thickness being formed in the collar panel and having a thickness that is less than the first thickness.

Preferably, the folded soft flexible edge is affixed by gluing only.

Preferably, the folded soft flexible edge comprises a pocket containing air.

There is also disclosed herein a method of forming a neck opening for a wetsuit comprising forming a channel of reduced thickness in piece of material to surround the neck opening in a wetsuit, and folding the material along a centreline of the channel to form a soft flexible edge.

The portion of the trunk that is folded about an area of reduced thickness to form a soft flexible edge provides a collar of the wetsuit.

Further aspects of the invention will become apparent from the following description, which is given by way of example only and is not intended to limit the scope of use or functionality of the invention.

BRIEF DESCRIPTION OF THE DRAWINGS

Preferred forms of the present invention will now be described by way of example with reference to the accompanying drawings wherein.

DESCRIPTION OF THE EXEMPLARY EMBODIMENTS

Figure 1:
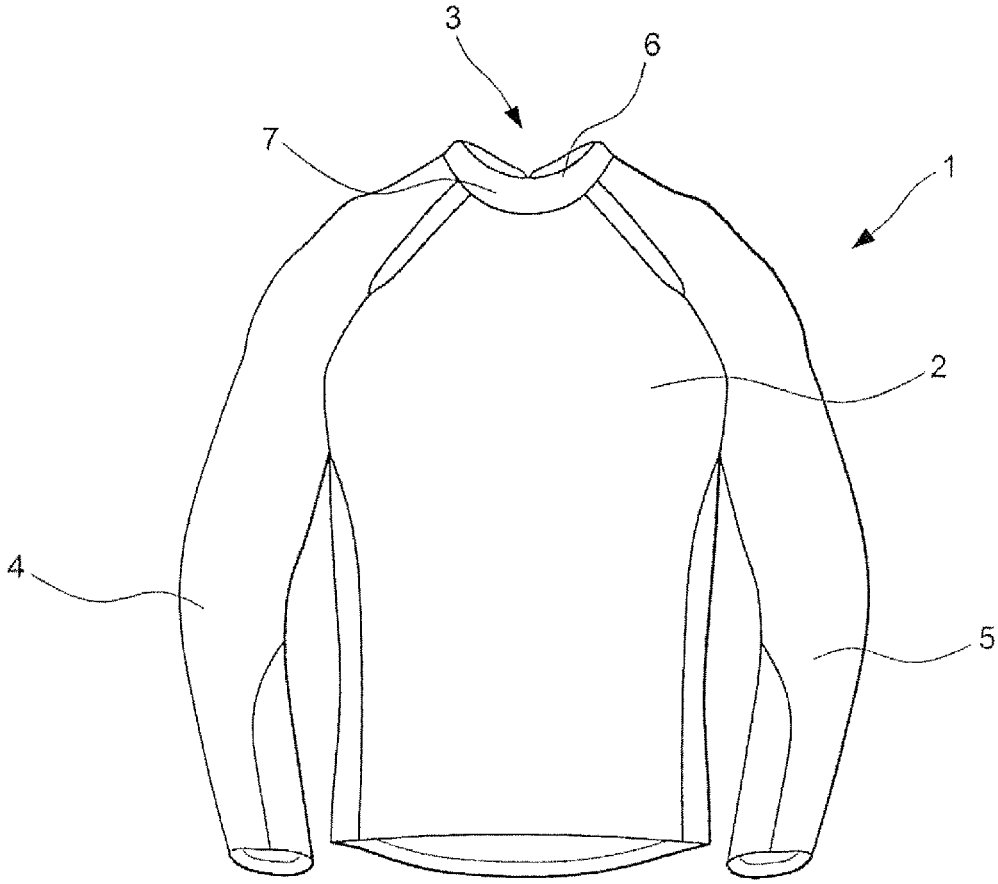
FIG. 1 is a front illustration of a wetsuit with neck opening according to the invention.
Figure 2:
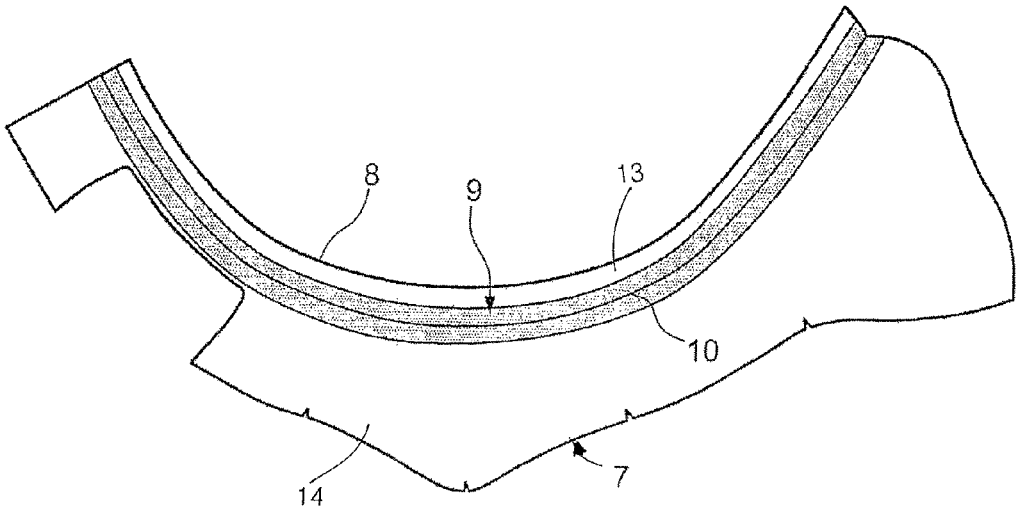
FIG. 2 is an illustrative view of a collar piece of the wetsuit.

In the drawings there is depicted a wetsuit 1 for use in water sports. The wetsuit 1 comprises a trunk portion 2 that fits about the torso of a wearer. The trunk portion has a pair of sleeves 4, 5 and a neck opening 3. The neck opening 3 has a thin rounded edge 6 that has improved comfort and flexibility over those of prior art wetsuits. The neck edge is formed by folding the wetsuit material adjacent the edge about an area of reduced thickness in order to form a thin folded edge 6. The folded portion is preferably only glued down, and not stitched, and optionally may have an air space within the folded portion of reduced thickness.

Figure 3:
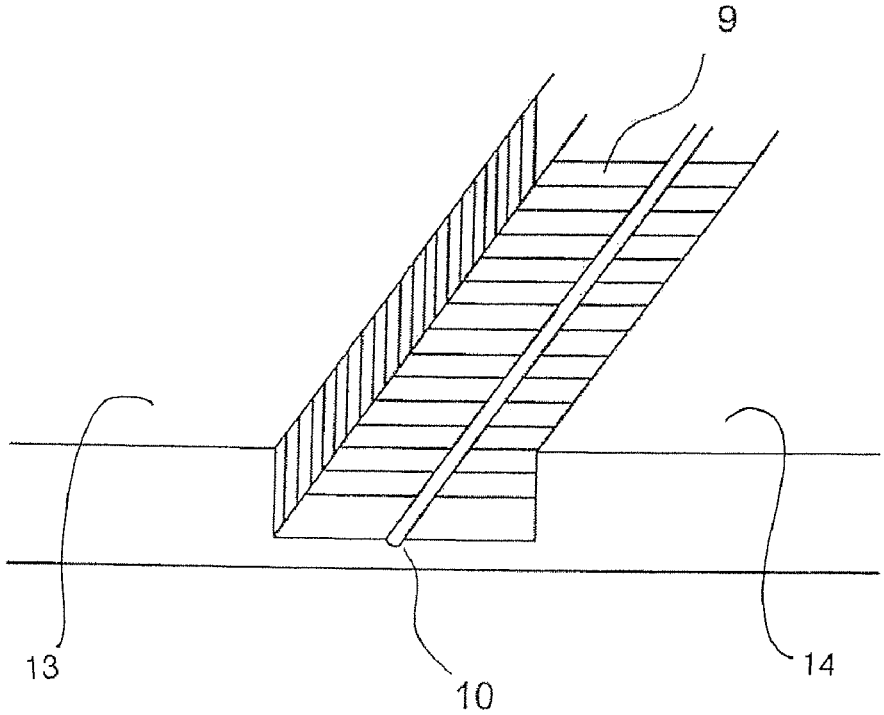
FIG. 3 is an illustration of a first step in making an edge of a wetsuit neck opening according to the invention.
Figure 4:
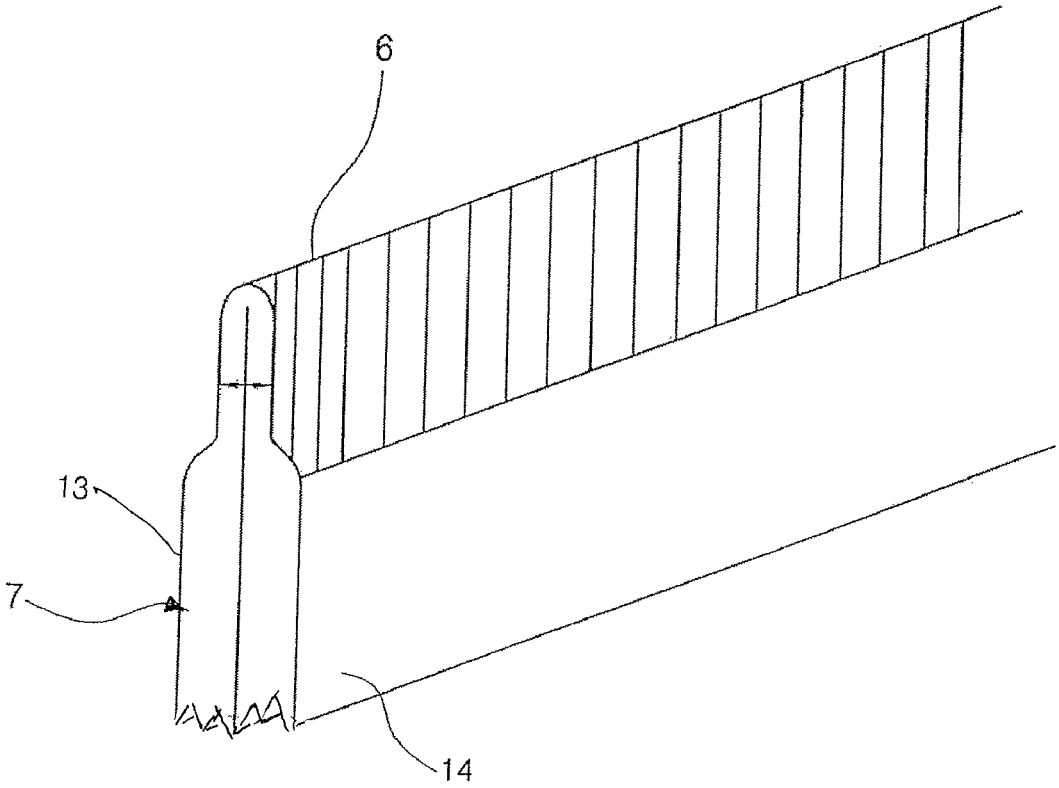
FIG. 4 is an illustration of a second step in making the edge of the wetsuit neck opening.
Figure 5:
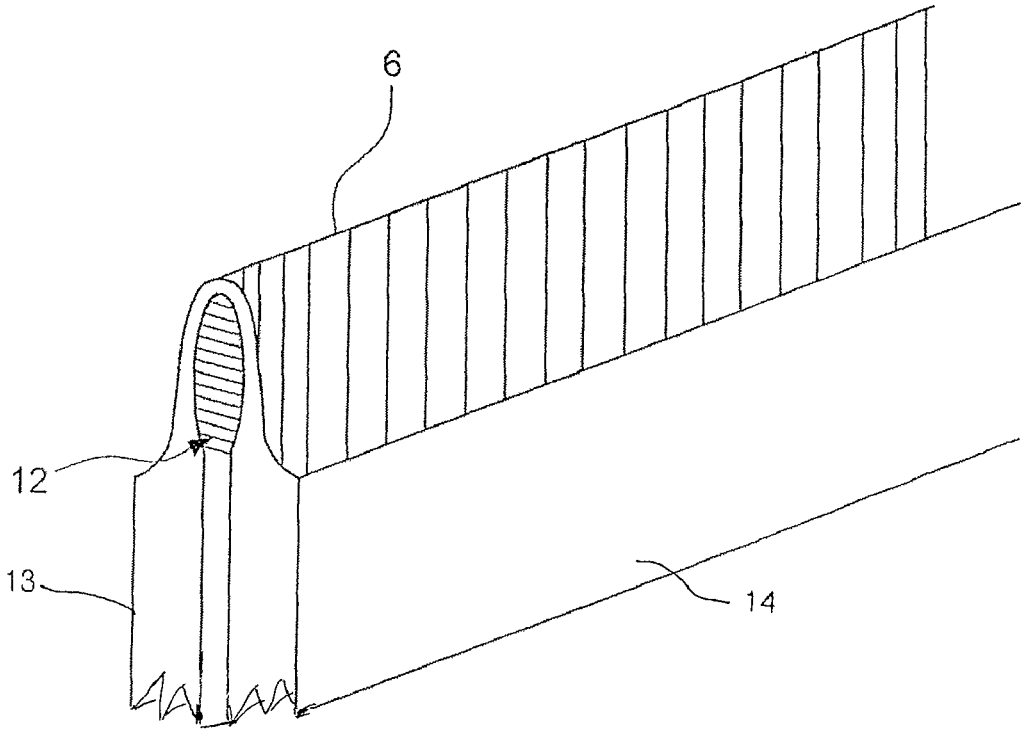
FIG. 5 illustrates an air filled embodiment of the edge of the wetsuit neck opening.

Turning to FIGS. 2-5, in forming the wetsuit neck opening of the wetsuit a wetsuit collar piece 7 is cut from synthetic rubber, such as neoprene, according to the wetsuit pattern. The collar piece 7 has a curved cut edge 8 that defines the wetsuit neck opening 3 when the collar 7 is incorporated into the wetsuit 1 at a trunk portion neck opening of the wetsuit. In order to provide a thin flexible folded edge 6, a strip of the collar piece 7 is stamped, pressed, or otherwise treated to provide a channel 9 of reduced thickness along a line that defines the collar edge 6. The channel 9 follows a curved, i.e., arcuate, path adjacent the curved cut edge 8 of the collar piece 7. As indicated in FIGS. 3-5, the channel 9 is located between first and second regions 13 and 14 of the collar piece 7. The channel 9 constitutes a third region of the collar piece 7. The collar piece 7 is then folded about a centreline 10 of the channel 9 so that the cut edge 8 is laid back over an inner portion of the neck collar piece 7. Thus, the folded edge 6 has, in cross-section, a U-shape, as shown in FIGS. 4 and 5. The cut edge 8 is bonded to the inner portion of the neck collar piece 7, at a location spaced from the folded edge 6, to maintain the folded edge 6. In folding the collar piece 7 about the centreline 10 of the channel 9, the folded edge 6, in situ, forms a surrounding edge of the wetsuit neck opening 3 that has a reduced thickness and so is softer, more flexible, and thus more comfortable to a wearer of a wetsuit incorporating the neck collar piece 7.

The folded over portions of the channel 9 are not bonded together so that a pocket is formed within the folded edge that may be injected with air 12. This adds a resiliently deformable cushion to the edge of the neck opening 3. Air is injected into the pocket by leaving a small part of the cut edge 8 unglued to provide an inlet port to the hollow pocket. Air is injected into the pocket and the remaining portion of cut edge 8 is glued down.

In the described embodiment the collar piece 7 is stamped to provide a channel 9 of reduced thickness, however this is not intended to limit the scope of use or functionality of the invention. The channel 9 of reduced thickness may be formed by any means known or devised in the art.

The invention claimed is:

1. A wetsuit comprising:

a trunk portion for fitting on a wearer's torso, the trunk portion having a pair of arm openings and a trunk portion neck opening; and a collar piece joined to the trunk portion at the trunk portion neck opening and defining a wetsuit neck opening, the collar piece including a single piece of a material having first, second, and third regions, with the third region located between the first and second regions, wherein the material has, in the first and second regions, a first thickness, when not compressed, between opposed first and second surfaces of the material, the material has, in the third region, a second thickness, when not compressed, smaller than the first thickness, between a third surface of the material and the second surface of the material, the third portion has, in cross-section, a U-shape defining a folded edge of the wetsuit neck opening, the folded edge has a thickness, when the material is not compressed, that is smaller than twice the first thickness, the first and second regions of the material contact and are joined to each other, free of stitches, at the second surface of the material, at a location spaced from the folded edge, and one of the first and second regions is joined to the trunk portion at the trunk portion neck opening.

2. The wetsuit of claim 1, wherein the material is a synthetic rubber.

3. The wetsuit of claim 1, wherein the first and second regions of the material are joined to each other at the second surface solely by gluing.

4. The wetsuit of claim 3, wherein at least parts of the second surface of the third region of the material, proximate the folded edge, are spaced apart from each other and define a closed pocket, and the pocket is filled with air.

5. The wetsuit of claim 1, wherein at least parts of the second surface of the third region of the material proximate the folded edge, are spaced apart from each other and define a pocket, and the pocket is filled with air.

6. A collar for a wetsuit comprising:

a collar piece defining a neck opening and including a single piece of a material having first, second, and third regions, with the third region located between the first and second regions, wherein the material has, in the first and second regions, a first thickness, when not compressed, between opposed first and second surfaces of the material, the material has, in the third region, a second thickness, when not compressed, that is smaller than the first thickness, between a third surface of the material and the second surface of the material, the third portion has, in cross-section, a U-shape defining a folded edge of the wetsuit neck opening, the folded edge has a thickness, when the material is not compressed, that is smaller than twice the first thickness, and the first and second regions of the material contact and are joined to each other, free of stitches, at the second surface of the material, at a location spaced from the folded edge.

7. The collar of claim 6, wherein the material is a synthetic rubber.

8. The collar of claim 6, wherein the first and second regions of the material are joined to each other at the second surface solely by gluing.

9. The collar of claim 8, wherein at least parts of the second surface of the third region of the material, proximate the centerline, are spaced apart from each other and define a closed pocket, and the pocket is filled with air.

10. The collar of claim 6, wherein at least parts of the second surface of the third region of the material, proximate the centerline, are spaced apart from each other and define a pocket, and the pocket is filled with air.

11. A method of forming a collar for a wetsuit comprising:

cutting a collar piece from a single sheet of a material having a first thickness, when not compressed, between opposed first and second surfaces of the material;

treating an intermediate portion of the collar piece to produce an arcuate channel in the material, the material at the arcuate channel having a second thickness, when not compressed, that is smaller than the first thickness, the arcuate channel extending from the first surface of the material toward the second surface of the material and having an arcuate centerline;

folding the collar piece along the arcuate centerline so that parts of the second surface of the material, on opposite sides of the arcuate channel and having the first thickness, are brought into contact with each other; and joining, free of stitches, the parts of the second surface that are in contact, whereby the material on opposite sides of the arcuate centerline defines a folded edge of a neck opening of the collar piece, the folded edge having a thickness, when not compressed, that is smaller than twice the first thickness.

12. The method of claim 11, including:

injecting air into a pocket between the parts of the second surface of the material that are in contact with and joined to each other and the folded edge, proximate the centerline, after folding and joining the material; and sealing the pocket at the portions of the second surface, thereby capturing the air within the pocket proximate the centerline.

13. The method of claim 11 including forming the channel by stamping.

* * * * *